United States Patent [19]

Yida

[11] Patent Number: 4,981,533

[45] Date of Patent: Jan. 1, 1991

[54] INTERNAL-OXIDATION METHOD OF ELECTRICAL CONTACT MATERIALS AND THE MATERIALS PRODUCED THEREBY

[75] Inventor: Masaharu Yida, Tokyo, Japan

[73] Assignee: Chugai Denki Kogyo K.K., Tokyo, Japan

[21] Appl. No.: 475,126

[22] Filed: Feb. 5, 1990

[51] Int. Cl.[5] ..... C22C 5/06

[52] U.S. Cl. ..... 148/431; 420/501

[58] Field of Search ..... 148/431; 420/501; 75/234, 951

[56] References Cited

U.S. PATENT DOCUMENTS 4,243,413 1/1981 Shibata ..... 148/431

4,672,008 6/1987 Shibata ..... 148/431

FOREIGN PATENT DOCUMENTS 55-113852 9/1980 Japan ..... 420/501

*Primary Examiner*—Theodore Morris

*Assistant Examiner*—Robert R. Koehler

*Attorney, Agent, or Firm*—Shlesinger, Fitzsimmons & Shlesinger

[57] ABSTRACT

Electrical contact materials are made by the internal-oxidation of Ag alloys containing more than 5 weight % of Sn, with the assistance of Pb or Zr contained at an amount as minimum as possible. Complete and uniform internal-oxidation of said Sn contents are obtained primarily on account of the internal oxidation conducted at an elevated oxygen atmospheric pressure, that is, 10 to 150 atm.

2 Claims, No Drawings

INTERNAL-OXIDATION METHOD OF ELECTRICAL CONTACT MATERIALS AND THE MATERIALS PRODUCED THEREBY

BACKGROUND OF THE INVENTION

This invention relates to a method for making electrical contact materials by the internal-oxidation of silver-solute metals alloys, whereby the solute metals in the silver matrix are converted to metal oxides which afford the alloys a high refractoriness. And, this invention also relates to such electrical contact materials, matrices of which are silver and which are produced in accordance with this invention method.

Silver-tin oxides alloys, matrices of which are silver and solute elements of which are tin which are in turn internal-oxidized to tin oxides, are widely employed today as electrical contact materials.

Similarly, silver-cadmium oxides alloys are known as efficient electrical contact materials, though compared to the silver-tin oxides alloys, they are less employed, because cadmium is harmful to health and because of the prevention of pollution.

However, there is a problem for preparing silver-tin oxides alloys by means of internal oxidation. That is, when a silver matrix of an alloy contains more than about 4.5 weight % of tin, the entire amount of such tin can hardly be internal-oxidized by oxygen which penetrates from the outside of the silver matrix and into the matrix.

In order to solve this problem, it becomes necessary to add to silver-tin alloys such auxiliary solute metals which have faster diffusion velocities and according are capable to carry and convey oxygen towards the inside of silver matrices fast. A typical example of such auxiliary solute metals is indium. In U.S. Patent No. 3,933,485, there is described that silver tin-indium system alloys are internal-oxidized to abtain excellent electrical contact materials. In this U.S. Patent, electrical contact materials which are one of the best electrical contact materials industrially used today, are made by internal-oxidizing silver alloys containing 5–10 weight % of tin and 1.0–6 weight % of indium.

However, even when indium which acts well as the above-mentioned auxiliary solute metal, is added, it is not easy to internal-oxidize tin of more than 4.5% most evenly in a silver matrix. Sometimes, tin oxides tend to segregate excessively about surface areas of the silver matrix, while they are depleted at inner areas. In addition to such drawback, indium oxides are comparatively weak.

Hence, it is desireable to internal-oxidize tin in a silver matrices without employing indium, if possible.

BRIEF SUMMARY OF THE INVENTION

In view of the above-mentioned background, the present inventor has sought for a method of the internal-oxidation of silver-tin alloys completely and evenly without employing any auxiliary solute metal element such as indium or at least with the employment of a minimum trace amount of the auxiliary solute metal element. He perceived Pb and Zr.

Either of Pb and Zr has very small solid-solubility with silver. Accordingly, when molten alloys of Ag-Sn-Pb or Ag-Sn-Zr are cooled to a solid phase, almost entire amounts of Pb or Zr contained in the alloys are precipitated dispersedly and evenly in the solid phase of Ag-Sn alloy structures. At a temperature between 500°–700° C. for the internal-oxidation, Pb or Zr atoms thus dispersedly precipitated remain in silver matrices as they were precipitated or as inter-metallic compounds produced with Sn at sites where they were precipitated, and act as nuclei for the oxidation and precipitation of Sn. Therefore, in this invention, as an auxiliary solute metal element which assists the internal-oxidation of Sn in Ag matrices, Pb or Zr is employed at an amount as much as small or at a nominal amount. The employment of Pb or Zr is advantageous also in respect of the fact that their oxides are not so weak, and zirconium oxides have a higher refractoriness than tin oxides.

In connection with the employment of Pb or Zr for the internal-oxidation of Ag Sn system alloys, it shall be noted that examples of the internal oxidation of Ag-Sn 6%-Pb 0.5% and Ag-Sn 6%-Zr 0.5% are given in Japanese Preliminary Patent Publication No. 51-121795, and an example of the internal oxidation of Ag-Sn 5% Pb 0.1% is also given in Japanese Preliminary Patent Publication No. 55-113852. In spite of such examples, it has been found by the present inventor that when Pb or Zr is employed at a trace amount such as 0.05–0.1 weight % as employed in this invention, it is impossible to internal-oxidize Sn of an amount of more that 5% completely and evenly all over the silver matrices as Sn oxides which are precipitated uniformally as fine particles.

Therefore, the present inventor has conducted a large number of various experiments, and discovered that even with Pb or Zr of such trace amount as 0.05–0.1 weight %, Ag-Sn alloys which contain Sn of more than 5% to 12%, an amount near to the upper limit of solid-solubility of Sn to Ag, can be internal-oxidized completely, if an oxygen atmosphere for the internal-oxidation is made remarkably high such as 10 atm and over.

That is, in this invention, a method of the complete internal oxidation of Ag alloys which is consisted of Sn of more than 5 weight % to 12 weight % and a balance of Ag, is provided in which Pb or Zr is added to the alloys at a trace amount of 0.05 weight % to 0.1 weight %, and the alloys are internal-oxidized at an oxygen atmosphere of more than 10 atm. This invention is also to provide electrical contact materials obtained by this method.

As described above, while in the method of this invention, the successful and complete internal-oxidation of AgSn alloys of the above-mentioned specific constituents can be made, if the internal-oxidation is conducted with an oxygen atmosphere of more than 10 atm, it is not desireable in respect of costs and safety to employ a very extremely high oxygen atmosphere at an industrial scale. In this view and in order to prevent Ag from becoming liquid (at about 400 atm) in the course of internal-oxidation, 150 atm of oxygen which can commercially be obtained, is selected as a maximum atmospheric pressure employable in this invention.

PREFERRED EMBODIMENTS

This invention is explained in a further concrete manner in the following examples.

AG-Sn 5 weight %-Pb 0.1 weight % (1)

Ag-Sn 6 weight %-Zr 0.1 weight % (2)

In order to confirm the present inventor's above-mentioned findings that Ag alloys containing Sn of 5 weight % and over, can not successfully be internal-oxidized by the mere addition of Pb or Zr of a trace amount, the above constituents (1) and (2) were melted and made to ingots of 120 mm in diameter and 40 mm in length. The ingots were hot-extruded into squre bars of 30 mm in thickness and 50 mm in width. The bars were then cut to a length of 500 mm each, and their upper and lower surfaces were shaved by a thickness of 3 mm each to obtain square bars of 24 mm in thickness, 510 mm in width, and 500 mm in length.

To each lower surface of the square bars, there were bounded pure silver of 2.5 mm in thickness. They were rolled by pressure so that they had thickness of 1.2 mm. By punching them by a punch having a cutting hole of 6 mm in diameter, disk-shaped contact materials backed by the pure silver and having 6 mm diameter and 1.2 mm thickness were obtained.

They were internal-oxidized by heating them to 620° C. for 24 hours in an oxygen atmosphere of 1 atm.

Vertically cut out sections of the contacts (1) and (2) thus obtained were observed by a microscope. It was observed that subscales made from segregations of metal oxides about surfaces prevented oxygen to penetrate inwardly and, consequently prevented the oxidation of the alloys at inner deeper areas.

Ag-Sn 5.5 weight %-Pb 0.05 weight % (3)

Ag-Sn 6 weight %-Zr 0.05 weight % (4)

Ag-Sn 8 weight %-Pb 0.1 weight %-Ni 0.2 weight % (5)

Alloys of the above constituents (3), (4), and (5) of this invention were made, similarly to the above (1) and (2), into disk-shaped contacts backed with pure silver, of 6 mm in diameter and 1.2 mm in thickness. They were internal-oxidized, similarly to the above (1) and (2), however that in this instance, the oxygen atmosphere was made to 30 atm.

Microscopic observation of the contacts thus internal-oxidized, along their vertically cut sections showed that they had structures evenly dispersed with metal oxides over and through their entire areas, similarly to the undermentioned (6) contacts, and that internal oxidation was completely made.

Ag-Sn 0.5 weight %-Cd 13 weight % (6)

For the sake of comparison, this conventional alloy (6) was prepared. Though this contains harmful Cd, it is known as it has fine and uniform internal oxidized structures, and in fact, it is one of the excellent today's electrical contact materials having good electrical properties.

This alloy (6) was internal-oxidized similarly to the alloys (1) and (2), that is, in a normal oxygen atmosphere.

Hardness (HRF) and electrical conductivity (IACS%) of the above internal-oxidized contact materials (3)–(5), and (6) were as follows.

| | Hardness | Electrical conductivity |
|---|---|---|
| (3) | 80 | 70 |
| (4) | 100 | 60 |
| (5) | 85 | 65 |
| (6) | 75 | 55 |

Welding times by anti-welding tests (conducted under electric voltage of DC 240V, initial electric current (discharge current from a condensor electric current) of 700A, contact pressure of 200g, and test cycles of 20) were as follows.

| | |
|---|---|
| (3) | 0 |
| (4) | 0 |
| (5) | 0 |
| (6) | 5 |

Amounts of consumption (mg) by ASTM test method (by electric voltage of AC 200V, electric current of 50A, contact pressure of 400g, and releasing force of 600g) were as follows.

| | |
|---|---|
| (3) | 15 |
| (4) | 12 |
| (5) | 10 |
| (6) | 20 |

As readily known from the above, this invention can provide electrical contact materials which are made by the internal-oxidation of Ag-Sn system alloys, provided with excellent electrical performance as electrical contacts on account of extremely fine metal oxides evenly and uniformally dispered in Ag matrices.

In this invention, as seen in the above example of alloy (5), one or more elements of iron family elements (Ni, Co, and Fe) may be added to alloys, solely for account of further fining alloy structures. But, this is neither intended for the acceleration nor assistance of internal oxidation by such elements.

I claim:

1. Electrical contact materials made of alloys consisting of Sn of more than 5 weight % to 12 weight %, Zr of 0.05–0.1 weight %, and the balance being Ag, which materials have been internal-oxidized in an oxygen atmosphere of 10–150 atm.

2. Electrical contact materials made of alloys consisting of Sn of more than 5 weight % to 12 weight %, Zr of 0.05–0.1 weight %, one more of the iron family elements of Ni, Co and Fe, in the amount of 0.001–0.1 weight %, and the balance being Ag, which materials have been internally oxidized in an oxygen atmosphere of 10–150 atm.

* * * * *

UNITED STATES PATENT AND TRADEMARK OFFICE

CERTIFICATE OF CORRECTION

PATENT NO. : 4,981,533

DATED : January 1, 1991

INVENTOR(S) : Masaharu Yida

It is certified that error appears in the above-identified patent and that said Letters Patent is hereby corrected as shown below:

On the title page, after item [22] insert the following paragraph:

-- [30] Foreign Application Priority Data

Jan. 19, 1990 [JP] Japan.....2-9909 --.

Signed and Sealed this

Twenty-third Day of March, 1993

*Attest:*

STEPHEN G. KUNIN

*Attesting Officer*

*Acting Commissioner of Patents and Trademarks*